United States Patent [19]

Smith et al.

[11] Patent Number: 4,703,403

[45] Date of Patent: Oct. 27, 1987

[54] POST TOP LUMINAIRE

[75] Inventors: Donald C. Smith, Auburn; Richard F. Snow, Manlius; George B. Pauli, Chittenango, all of N.Y.

[73] Assignee: Crouse-Hinds Company, Syracuse, N.Y.

[21] Appl. No.: 352,129

[22] Filed: Feb. 25, 1982

[51] Int. Cl.[4] ..... F21V 3/00

[52] U.S. Cl. ..... 362/268; 362/311; 362/331; 362/332; 362/337; 362/355; 362/363

[58] Field of Search ..... 362/311, 333, 334, 338, 362/340, 355, 361, 363, 375, 431, 376, 268, 331, 332, 337

[56] References Cited

U.S. PATENT DOCUMENTS

| | | | |
|---|---|---|---|
| 2,773,171 | 12/1956 | Pennow | 362/363 |
| 2,773,172 | 12/1956 | Pennow | 362/363 |
| 3,194,956 | 7/1965 | Troccoli | 362/363 |
| 3,628,006 | 12/1971 | Sprunt et al. | 362/363 |
| 4,142,179 | 2/1979 | Lowndes | 362/363 |

*Primary Examiner*—Stephen J. Lechert, Jr.

*Attorney, Agent, or Firm*—Chilton, Alix & Van Kirk

[57] ABSTRACT

A luninaire adapted to be mounted at the top of a post and to direct light below a horizontal plane is disclosed. A housing element preferably of a polycarbonate material comprises a housing for an electrical system and a refractor means having an interior and exterior prismatic structure.

23 Claims, 8 Drawing Figures

$A_1$
$A_2$
$A_3$
$A_M$
$D_1$
$D_2$
$D_3$
$D_I$
$D_{II}$
$D_{III}$
$D_{IV}$
$D_{M-1}$
$G_1$
$G_2$
$G_3$
$G_4$
$P_1$
$P_2$
$P_3$
$P_4$
$P_M$
16
8
8
$Q_1$
$Q_2$
$Q_3$
$Q_4$

POST TOP LUMINAIRE

BACKGROUND OF THE INVENTION

This invention relates to a luminaire adapted to be mounted at the top of a post and to project or to direct light below a horizontal plane. More particularly, this invention is directed to a luminaire having a new and improved refractor structure adapted for outdoor use.

The present invention is specifically directed to use in an outdoor environment where efficient illumination, durability and resistance to vandalism are important considerations. The invention also provides a new and improved luminaire which is aestheticly attractive and relatively easy to maintain.

A number of prior art luminaires have incorporated prismatic structures to facilitate the directing and distribution of light from the luminaire. U.S. Pat. Nos. 31,353; 31,149,747 and 3,344,268 all generally disclose the concept of employing a multiplicity of prisms in the form of vertical or horizontal rib structure to distribute or direct the light from a luminaire. U.S. Pat. No. 3,395,273, discloses a street lamp luminaire comprising a plurality of prisms for directing light below the horizontal plane of the luminaire. The present invention is directed to providing a series of prismatic structures at both the exterior and interior of a refracting portion of an element having a unique integrated structure adapted to accomplish a number of additional objectives as will be pointed out below.

The use of a polycarbonate material in a refracting element for a street light luminaire is disclosed in U.S. Pat. No. 3,661,685. The present invention is a new and improved luminaire which employs the properties of polycarbonates not only to provide a refracting element having efficient optical qualities, but also to provide a durable element adapted for use in an outdoor environment.

SUMMARY OF THE INVENTION

The new and improved luminaire comprises a base having a means for mounting the luminaire at the top of a post and generally supporting an electrical system for a lamp. A polycarbonate housing, which is of a substantially cylindrical shape and having a substantially H-shaped cross-section, is received on the base plate. The housing functions to provide both a refracting component for the lamp and to provide the required isolation of the electrical circuit components associated with the lamp.

The housing is further provided with a series of longitudinally arranged prisms on the interior of the refracting portion, as well as a series of circumferentially extending prisms on the exterior of the refracting portion. The prisms on the exterior of the refracting portion are preferably structured and positioned according to specific parameters so that the light may be efficiently directed and distributed below a horizontal plane defined by the luminaire.

The new and improved luminaire also comprises a housing which may be provided with an opaque portion to conceal the electrical system. Additional means may be provided to conceal the exterior support structures and increase the resistance of the luminaire structure to environmental elements and vandalism.

An object of the invention is to provide a new and improved luminaire which is adapted to be mounted at the top of a post and to direct light below a horizontal plane.

An object of the invention is to provide a new and improved luminaire which is durable and adapted to be resistant to vandalism.

An object of the invention is to provide a new and improved luminaire which is relatively easy to install and maintain.

An object of the invention is to provide a new and improved luminaire which has an efficient optical performance specifically suited to public use in an outdoor environment.

Other objects and advantages of the invention will become apparent from the accompanying drawings and the detailed description.

DETAILED DESCRIPTION

Figure 1:
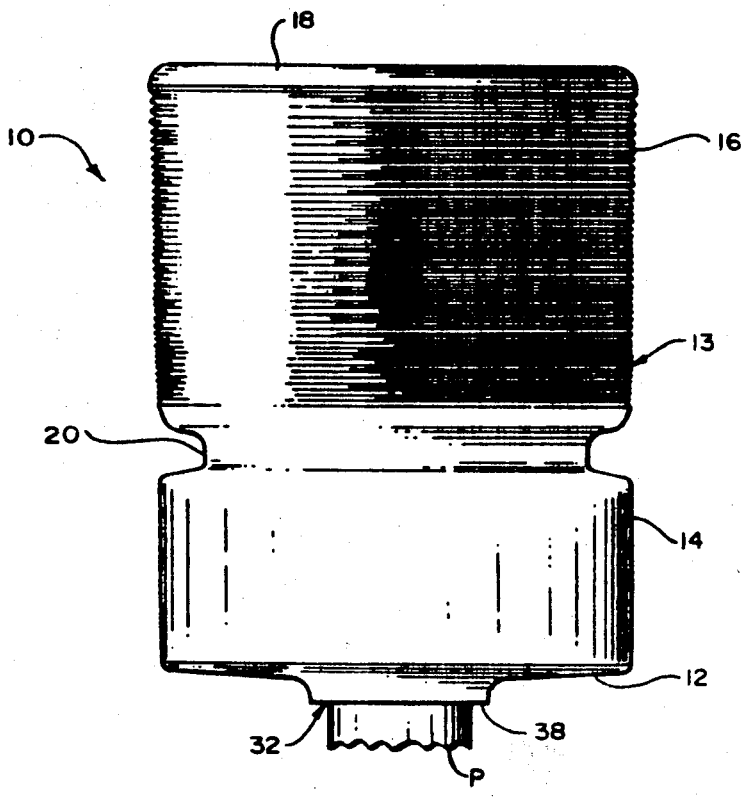
FIG. 1 is a front view of the luminaire mounted on the top of a post, the side and rear views of the luminaire being substantially identical.

With reference to FIG. 1, the luminaire 10 is illustrated in its preferred position mounted at the top of a post P in an outdoor environment. The external structure of the luminaire 10 is substantially symmetrical about a central vertical axis, and thus FIG. 1 illustrates the exterior of the luminaire 10 as viewed from substantially any peripheral position relative to the luminaire in the horizontal plane thereof. From an external perspective, luminaire 10 generally comprises a fixture base 12 supporting a housing element 13 comprising an electrical housing 14 and a lens cover 16. A cover plate 18 encloses the lens cover 16.

Figure 2:
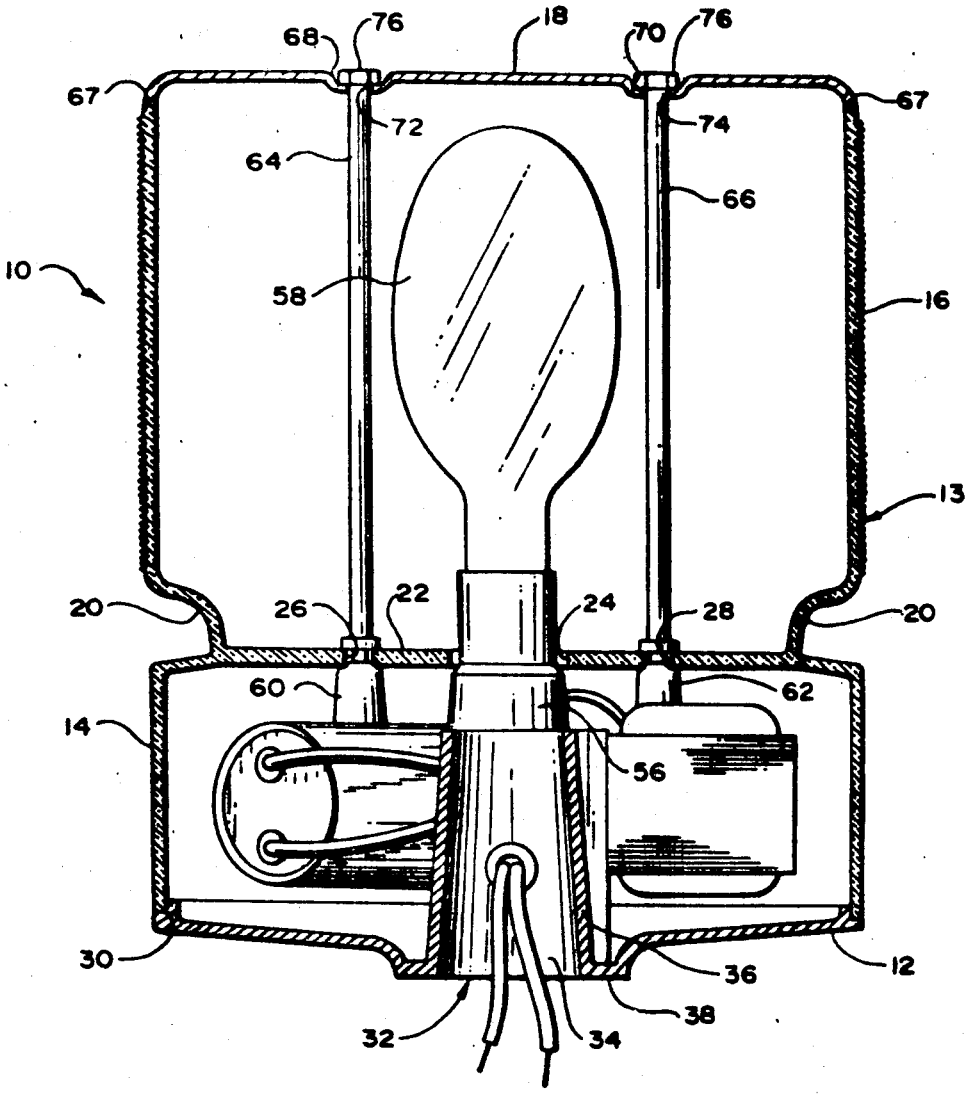
FIG. 2 is an interior view of the luminaire of FIG. 1, the external portion being broken away along a central vertical plane.

With reference to FIG. 2, housing element 13 generally comprises a cylindrical structure having a circumferential recessed portion 20 and a substantially H-shaped cross-section. An integral central interior panel 22 positioned proximate recessed portion 20 generally defines the boundary between lens cover 16 and electrical housing 14. Panel 22 functions in part as an electrical insulator to form the top of the electrical housing 14 for the luminaire electrical system which will be described below. Panel 22 further comprises a central lamp aperture 24 as well as a pair of rod apertures 26 and 28, the function of which will be described below.

Housing element 13 is preferably made of a polycarbonate material of a durable and rugged quality which is impervious to high impact and possesses a resilience which allows housing element 13 to withstand intense abuse. The structural configuration proximate the intersection of panel 22 with the recessed portion 20 intermediate lens cover 16 and electrical housing 14 acts to provide for a resilient structure in the H-shaped housing element 13. An important feature of housing element 13 is the ability of the element to withstand abuse and vandalism since the usual environment of the invention is an outdoor public use area.

Fixture base 12 is structured to receive the lower portion of housing element 13. A rabbet 30 may be provided on base 12 to facilitate the reception of the housing element 13 onto the fixture base 12. A mounting means shown generally as 32 is centrally provided in fixture base 12 to facilitate the mounting of the luminaire at the top of a post. A preferred means for mounting luminaire 10 is in conjunction with a post having a post tenon (not shown) which can be received and secured in tenon aperture 34 defined by a tapered cylindrical wall 36. This arrangement assures the alignment of the luminaire with the post and accommodates manufacturing tolerances. A lower fixture portion 38 may rest on the top of the post proximate the tenon extension. In preferred form the fixture base and mounting means cooperate with the top of the post in such a manner that the post and fixture base appear to form an integral structure having a smooth surface continuum with a minimal degree of discontinuity between the post and the luminaire so that the external appearance does not present a ready clue as to how the luminaire may be dismounted or disassembled.

Figure 3:
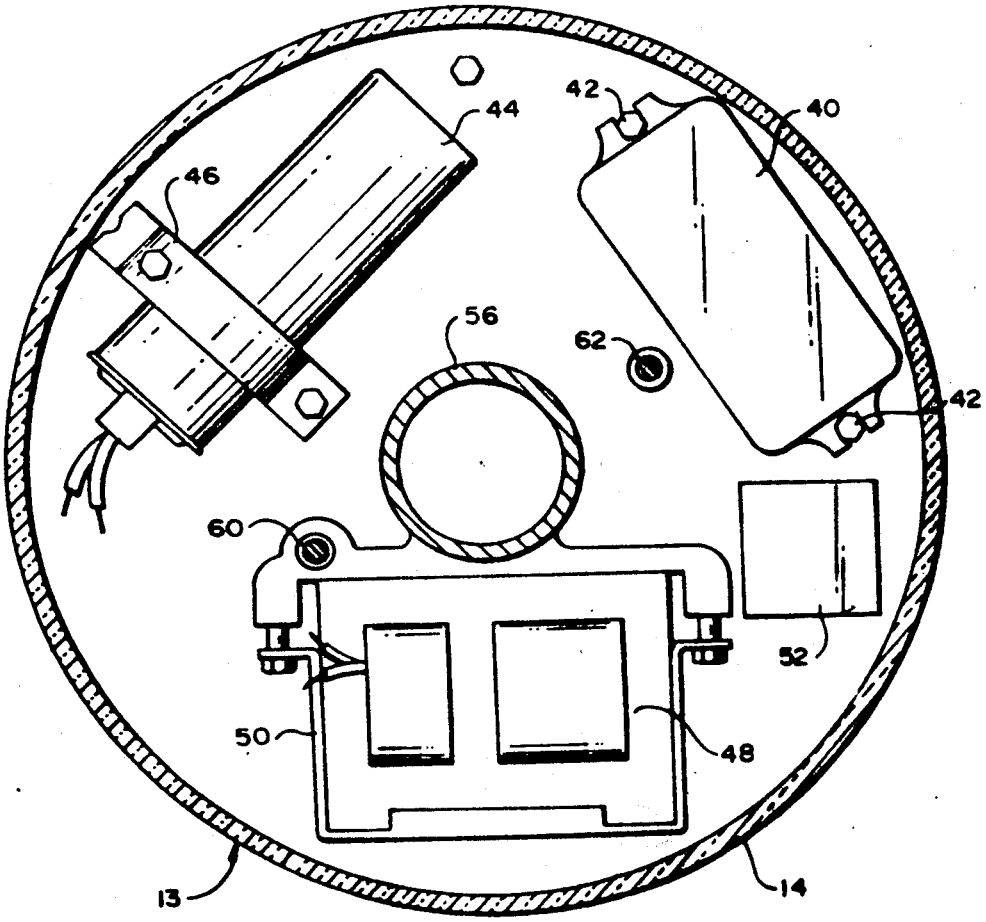
FIG. 3 is a top plan view, partly in schematic form, illustrating a lower portion of the luminaire of FIG. 2.

Fixture base 12 also provides a support structure for the electrical system and the lamp. With reference to FIG. 3, starter 40 is secured to the top of the fixture base by conventional means such as screws 42. Capacitor 44 is secured to fixture base 12 by capacitor strap 46. Ballast 48 is secured to mounting means 32 of fixture base 12 by means of a ballast mounting strap 50. A wiring diagram 52 may also be affixed to the fixture base 12. In preferred form, lamp base 56 is positioned above mounting means 32. Lamp 58 is received in base 56. It is of course understood that the foregoing starter 40, capacitor 44, ballast 50, and lamp 58 are electrically connected, and are representative of a number of electrical lamp systems that may be employed in connection with the luminaire. It is to be understood that the electrical lamp system may take a variety of forms and the electrical components illustrated herein are a preferred embodiment and not a limitation as to the application or scope of the invention.

A pair of support brackets 60 and 62 adapted to receive the ends of the fastener rods 64 and 66 extend upwardly from fixture base 12. When properly positioned, rod recesses 26 and 28 of the panel 22 align with brackets 60 and 62 so that fastener rods 64 and 66 may be threadably received in brackets 60 and 62 to secure panel 22 and hence housing element 13 to the fixture base 12.

Cover plate 18 comprises a rabbet 67 which engages with the top of housing element 13 and a pair of recessed portions 68 and 70, each having apertures 72 and 74 which align with fastener rods 64 and 66 to receive upper rod ends opposite the ends received in brackets 60 and 62. A pair of nuts 76, which may be tightened to secure cover plate 18 against the top of the lens cover 16 of housing element 13 are preferably received in recessed portions 68 and 70 so that the nuts 76 are not readily visible from ground or street level.

Figures 4, 5, 6, 7, 8:
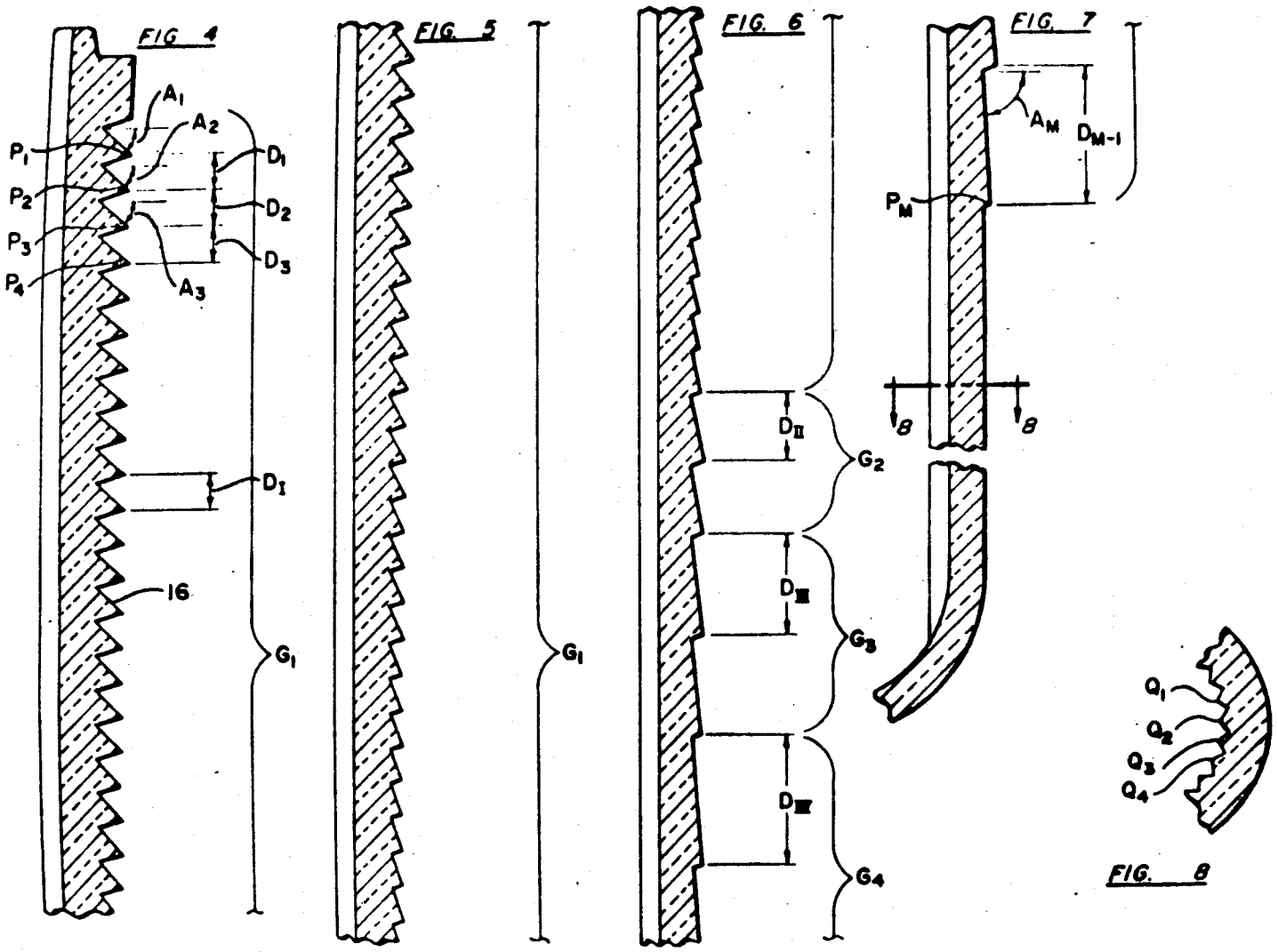
FIGS. 4–7 are each enlarged fragmentary sectional views of the upper side portion of the luminaire of FIG. 2.
FIG. 8 is a sectional view taken along the line 8—8 of FIG. 7.

With reference to FIGS. 4–7, the exterior of the lens cover 16 is provided with a plurality of parallel prisms protruding outwardly and circumferentially around the exterior of the housing element 13. Each prism is defined by intersecting upper and lower surfaces. The prisms function to direct and distribute the light generated by the lamp below the horizontal plane of the luminaire. With further reference to FIG. 4, the successive adjacent prisms from top to bottom are designated $P_1, P_2, P_3, \ldots, P_m$. The distances between successive adjacent prisms which may be defined as the vertical distances between the intersection of the upper and lower surfaces, are designated $D_1, D_2, D_3, \ldots, D_{m-1}$.

The angles of protrustion designated $A_1, A_2, A_3, A_4, \ldots A_m$ are defined as the angles that the upper surfaces of each prism $P_1, P_2, P_3, P_4, \ldots P_m$ makes with the horizontal. As can be ascertained from FIGS. 4–7, the sequence of the angles of protrusion $A_1, A_2, A_3, A_4, \ldots A_m$ is given by the relationship:

$$A_n \leqq A_{n+1}.$$

In a preferred embodiment, the angles of protrustion $A_1, A_2, A_3, A_4, \ldots A_m$, increase sequentially from approximately 39 degrees to approximately 87 degrees. The angles of elevation relative to the horizontal of the lower surfaces are acute angles of magnitudes substantially less than 45 degrees.

With further reference to FIGS. 4–7, the distances between adjacent prisms may be divided into four groups designated $G_1$, $G_2$, $G_3$, and $G_4$. Within each group the distance $D_n$ between successive adjacent prisms is contsant. In a preferred embodiment, the distances $D_1, D_2, D_3, \ldots D_{m-1}$, satisfy the following relationship:

$$D_n \geqq D_{n+1},$$

where $D_1, D_2, D_3 \ldots D_{m-1}$ are the distances between successive adjacent prisms $P_1, P_2, P_3, P_4, \ldots, P_m$. In addition, the relationships between the constant distances between adjacent prisms of each of the groups is defined by the following relationship:

$$D_{II} = 2D_I$$

$$DIII = 3D_I$$

$$D_{IV} = 4D_I$$

where $D_I$ is the constant distance between adjacent prisms in the first group, $D_{II}$ is the constant distance between adjacent prisms in the second group, $D_{III}$ is the constant distance between adjacent prisms in the third group, and $D_{IV}$ is the constant distance between adjacent prisms in the fourth group.

With reference to FIG. 8, a plurality of parallel prisms protrudes from lens cover 16 into the interior of housing element 13. The prisms which extend into the interior are designated generally as $Q_I, Q_2, Q_3, Q_4, \ldots$ The latter prisms in preferred form are defined by pairs of intersecting surfaces substantially equally spaced around the interior circumference of lens cover 16 and extending longitudinally in a vertical direction from the top of the lens cover 16 proximate housing cover 18 to proximate the recessed portion 20. In preferred form, the faces of prisms $Q_I, Q_2, Q_3, Q_4, \ldots$ are congruent and intersect at substantially 90 degree angles.

The series of prisms protruding from the exterior of the lens cover 16, together with the series of prisms protruding into the interior of lens cover 16, provide a soft evenly distributed light which is directed downwardly in an efficient manner from the horizontal plane of the luminaire. The luminaire during daylight hours, by virtue of the exterior series of prisms, presents the appearance of a fine crystalline cut glass structure. The prisms also function to prevent the luminaire interior from being externally visible.

Housing element 13, which integrates into a single element the lens cover and electrical system cover, acts to provide a luminaire which is relatively easy to install and maintain. The luminaire may be installed by first mounting the fixture base on a post tenon. The electrical system of the luminaire is connected to wires extending preferably through the center of the post. Housing element 13 is secured to the fixture base, by aligning the recesses 26 and 28 of panel 22 of the housing with the support brackets 60 and 62, engaging fastener rods 64 and 66 into the brackets and securing cover plate 18 to the top of housing element 13 by bolting nuts 76 to the top of the fastener rods.

Because of the polycarbonate material used in the housing, the luminaire will be relatively indestructable and is adapted to withstand intentional abuse as well as the adverse effects caused by atmospheric conditions and weather.

An important design feature of a preferred embodiment of the luminaire is the provision whereby the luminaire structure is adapted to hide various connecting elements which, if easily visible, could be the initial impetus to vandalism and unauthorized access to the luminaire. In a preferred form, an opaque material is applied to the inside surfaces of the sides of the electrical housing 14 so that the bottom portion of the luminaire appears to be a base which receives a removable light refracting globe. In addition, the color of the electrical housing can be made to match the color of the fixture base and for that matter the color of the post so that it is difficult to ascertain from ground level or street level that the electrical housing, fixture base and pole are separate components.

An additional feature is that by essentially securing the luminaire at the top by tightening the nuts 76 so that they are received in the recessed portions 68 and 70 of the cover place 18, it is difficult for one unfamiliar with the luminaire to determine how to remove the lens cover or change the lamp bulb. It is, of course, also apparent that authorized access to the lamp bulb can be easily obtained by merely loosening the nuts 76 and removing the cover plate 18. The integral structure of housing element 13 obviates the necessity to remove the lens cover or align same with the base as required with conventional globe/base light fixtures.

It may thus be seen that the objects of the invention set forth, as well as those made apparent from the foregoing desription, are efficiently obtained. While preferred embodiments of the invention have been set forth for purposes of disclosure, modifications of the disclosed embodiments of the invention as well as other embodiments thereof may occur to those skilled in the art. Accordingly, the appended claims are intended to cover all embodiments of the invention which do not depart from the spirit and scope of the invention.

What is claimed is:

1. A luminaire adapted to be mounted at the top of a post and to direct light below a horizontal plane, said luminaire comprising:

a base having a mounting means for mounting said luminaire above an area to be lighted:

an electrical means positioned on said base to operate a lamp;

a unitary housing element received on said base, said housing element having upper and lower portions of generally cylindrical shape with an intermediate interior insulator panel intersecting the housing element sides to form a substantially H-shaped crosssection, the lower cylindrical portion enclosing said electrical means and the upper cylindrical portion forming a light refractor means for said lamp, the light refractor means comprising an interior longitudinally disposed prism means and exterior prism means adapted to direct light below the horizontal plane defined by the top of the unitary housing element; and a cover enclosing the top of said housing element.

2. A unitary lens cover for a luminaire of a type having an electrical means to operate a lamp and adapted to direct light below a horizontal plane, said lens cover comprising upper and lower portions of generally cylindrical shapes with an intermediate insulator panel intersecting the cover sides to form a substantially H-shaped cross-section, said upper portion having a light refracting means comprising an interior longitudinally disposed prism means and an exterior prism means adapted to direct light below the horizontal plane defined by the top of lens cover.

3. The luminaire of claim 1 wherein said housing element further comprises a circumferential recessed portion proximate the intersection of the interior panel with the sides.

4. The luminaire of claim 1 wherein said refractor means comprises a plurality of parallel prisms extending longitudinally at the interior of said housing.

5. The luminaire of claim 4 wherein said refractor means further comprises a series of successive adjacent parallel prisms circumferentially protruding at the exterior of said housing, said series of prisms being designated $P_1$, $P_2$,$P_3$, $P_4$ . . . , $P_m$, $P_1$ being the prism nearest the cover.

6. The luminaire of claim 5 wherein angles of protrusion $A_1$, $A_2$, $A_3$, $A_4$, . . . $A_m$ of the corresponding prisms $P_1$, $P_2$, $P_3$,$P_4$, . . . $P_m$ satisfy the relationship:

$$A_N \geqq A_{N+1};$$

where $A_1$, $A_2$, $A_3$, $A_4$, . . . $A_m$ are the corresponding angles of protrusions of prisms $P_1$, $P_2$, $P_3$, $P_4$, . . . $P_m$ relative to the horizontal.

7. The luminaire of claim 5 wherein the corresponding distances $D_1$, $D_2$, $D_3$, . . . , $D_{m-1}$ . . . between prisms P1, P2, P3, P4 . . . satisfty the relationship:

$$D_n \leqq D_{n+1};$$

where $D_1$, $D_2$, $D_3$, . . . $D_{m-1}$ are the distances between successive prisms $P_1$, $P_2$, $P_3$, $P_4$, . . . $P_m$.

8. The luminaire of claim 3 wherein the housing element portion proximate said recessed portion is resilient.

9. The luminaire of claim 1 further comprising a faster means to secure the cover, said fastener means adapted to be concealed.

10. The luminaire of claim 9 wherein said fastener means further comprises a pair of rods extending from said base plate and adapted to be received and secured in recessed portions of said cover plate.

11. The luminaire of claim 1 wherein said housing element is made of polycarbonate.

12. The luminaire of claim 1 wherein said mounting means further comprises a central aperture adapted to receive a post tenon.

13. The luminaire of claim 1 wherein the interior surface of said lower cylindrical portion is opaque.

14. The lens cover of claim 2 wherein said cover is made of polycarbonate.

15. The lens cover of claim 2 further comprising a resilient portion proximate the periphery of the interior panel.

16. The lens cover of claim 2 wherein the interior of said lower cylindrical portion is opaque.

17. The lens cover of claim 2 wherein said panel has a central aperture.

18. The lens cover of claim 2 wherein said interior prism means comprises a plurality of prisms longitudinally positioned and extending into the interior of the refractor portion.

19. The lens cover of claim 2 wherein the exterior prism means comprises a series of adjacent parallel prisms extending circumferentially around the exterior.

20. The lens cover of claim 19 wherein the distance between successive adjacent prisms from the top of the lens cover to the bottom does not decrease.

21. The lens cover of claim 2 wherein the prisms extend at angles to the horizontal such that the angle of protrusion for each succeeding prism from the top to the bottom is greater or equal to the corresponding angle of protrusion of the preceding prism.

22. The lens cover of claim 18 wherein the interior prism means comprise prisms having substantially congruent faces intersecting at substantially 90 degrees.

23. The lens cover of claim 19 wherein the series of prisms comprises four groups, each group having a constant distance between adjacent prisms $D_I$, $D_{II}$, $D_{III}$, and $D_{IV}$, satisfying the relationship:

$$D_{II}=2D_I$$

$$D_{III}=3D_I$$

$$D_{IV}=4D_I$$

where $D_I$ is the constant distance between adjacent prisms in the first group, $D_{II}$ is the constant distance between adjacent prisms in the second group, $D_{III}$ is the constant distance between adjacent prisms in the third group, and $D_{IV}$ is the constant distance between adjacent prisms in the fourth group.

* * * * *

UNITED STATES PATENT AND TRADEMARK OFFICE

CERTIFICATE OF CORRECTION

PATENT NO. : 4,703,403

DATED : October 27, 1987

INVENTOR(S) : Donald C. Smith, Richard F. Snow and George B. Pauli

It is certified that error appears in the above-identified patent and that said Letters Patent is hereby corrected as shown below:

Claim 1, line 13, "crosssection" should be -- cross-section --.

Claim 6, line 4, " $\geqq$ " should be -- $\leqq$ --.

Claim 9, line 1, "faster" should be -- fastener --.

Signed and Sealed this

Nineteenth Day of April, 1988

*Attest:*

DONALD J. QUIGG

*Attesting Officer*

*Commissioner of Patents and Trademarks*